United States Patent [19]

Lanier et al.

[11] Patent Number: 4,928,957

[45] Date of Patent: May 29, 1990

[54] EXERCISE APPARATUS FOR ACTIVELY EXERCISING THE UPPER BODY WHILE PASSIVELY EXERCISING THE LOWER BODY

[75] Inventors: Joel P. Lanier, Nashville; Tamuel A. Hall, Chattanooga; Kent R. Moore, Hixson, all of Tenn.

[73] Assignee: University of Tennessee Research Corporation, Knoxville, Tenn.

[21] Appl. No.: 279,470

[22] Filed: Dec. 2, 1988

[51] Int. Cl.[5] ..... H63B 69/06

[52] U.S. Cl. ..... 272/72; 272/130; 272/134

[58] Field of Search ..... 272/134, 144, 130, 72, 272/126, 116, 96; 128/25 R, 25 B

[56] References Cited

U.S. PATENT DOCUMENTS

| | | | |
|---|---|---|---|
| 682,988 | 9/1901 | Hazelip | 272/72 |
| 1,982,843 | 12/1934 | Traver | 272/72 |
| 2,227,526 | 1/1941 | Wilson | 128/25 R |
| 2,682,402 | 6/1954 | McCarthy | 272/83 |
| 3,039,456 | 6/1962 | Luce | 128/25 R |
| 3,112,108 | 11/1963 | Hanke | 272/58 |
| 3,770,267 | 11/1973 | McCarthy | 272/72 X |
| 4,272,074 | 6/1981 | Sferle | 272/120 |
| 4,468,025 | 8/1984 | Sferlee | 272/120 |
| 4,509,509 | 4/1985 | Bouvet et al. | 128/24.1 |
| 4,549,534 | 10/1985 | Zagorski et al. | 128/25 R |
| 4,637,379 | 1/1987 | Seringer | 128/25 R |
| 4,700,946 | 10/1987 | Breunig | 272/134 |
| 4,706,953 | 11/1987 | Graham | 272/134 X |
| 4,741,530 | 5/1988 | Wolf | 272/134 |

FOREIGN PATENT DOCUMENTS

| | | | |
|---|---|---|---|
| 2944599 | 5/1981 | Fed. Rep. of Germany | 272/96 |
| 7505432 | 11/1975 | Netherlands | 272/130 |
| 2128885 | 5/1984 | United Kingdom | 272/72 |

*Primary Examiner*—Richard J. Apley
*Assistant Examiner*—H. Flaxman
*Attorney, Agent, or Firm*—Luedeka, Hodges & Neely

[57] ABSTRACT

An exercise apparatus for bending the user's legs by the exercise of muscles in the user's upper body includes a stationary frame, a seat mounted upon the frame for forward and rearward movement relative thereto and hinged leg support sections which fold and unfold in synchronism with the forward and rearward movement of the seat. To use the apparatus, a user sits upon the seat with his legs draped over the hinged leg supports and he pushes and pulls upon the stationary frame to effect the forward and rearward movement of the seat relative to the frame. As the leg support sections are folded and unfolded in response to the forward and rearward movement of the seat, the user's legs are bent at the waist and knees. A hydraulic cylinder is interposed between the frame and seat providing an adjustable resistance to the forward and rearward movement of the seat.

6 Claims, 3 Drawing Sheets

EXERCISE APPARATUS FOR ACTIVELY EXERCISING THE UPPER BODY WHILE PASSIVELY EXERCISING THE LOWER BODY

BACKGROUND OF THE INVENTION

This invention relates generally to exercise apparatus and relates more particularly to such an apparatus intended to actively exercise one part of a user's body while passively exercising another part of the user's body.

It is known that an individual, such as a paraplegic, who has lost his ability to move his legs under his own power should nevertheless take steps to maintain his range of leg motion. If his range of leg motion is not maintained, the individual may suffer such problems as extension contractures at the hip, knee or ankle, experience heterotopic ossification at his leg joints, or develop short heel cords. Other problems which may arise from lack of leg movement include atrophy of muscle, connective or skin tissues of the immobile parts of the body.

It is an object of the present invention to provide a new and improved exercise apparatus enabling an individual who is unable to move his legs under his own power to bend and thereby exercise his legs by the exertion of muscles in his upper body.

Another object of the present invention is to provide such an apparatus which is well-suited for use by an individual, such as a paraplegic, and which is designed to build strength and endurance enabling the individual to more easily transfer himself to and from a wheelchair and roll the wheelchair and to reduce the individual's chances of experiencing health-related problems which may arise through leg inactivity.

Still another object of the present invention is to provide such apparatus for actively exercising the upper body of an individual while passively exercising the lower body of the individual.

A further object of the present invention is to provide such an apparatus providing a resistance to the active exercising of the upper body and wherein such resistance is adjustable.

A still object of the present invention is to provide such an apparatus which is uncomplicated in construction and effective in operation.

SUMMARY OF THE INVENTION

This invention resides in an exercise apparatus for actively exercising the upper body of a user while passively exercising the lower body of the user.

The exercise apparatus is comprised of a frame, a seat and leg-supporting means. The frame has a stationary portion adapted to be pushed and pulled upon by the arms of a user, and the seat is mounted upon the frame for forward and rearward movement relative to the frame as the user pushes and pulls upon the stationary portion of the frame. The leg-supporting means are connected between the seat and the frame to effect a bending of the user's legs at the waist and knees as the seat is moved forwardly and rearwardly relative to the frame. Hence, the upper body of the user is actively exercised as he pushes and pulls upon the stationary portion of the frame, and the lower body of the user is passively exercised as his legs are bent in response to the forward and rearward movement of the seat.

DETAILED DESCRIPTION OF THE ILLUSTRATED EMBODIMENT

Figure 1:
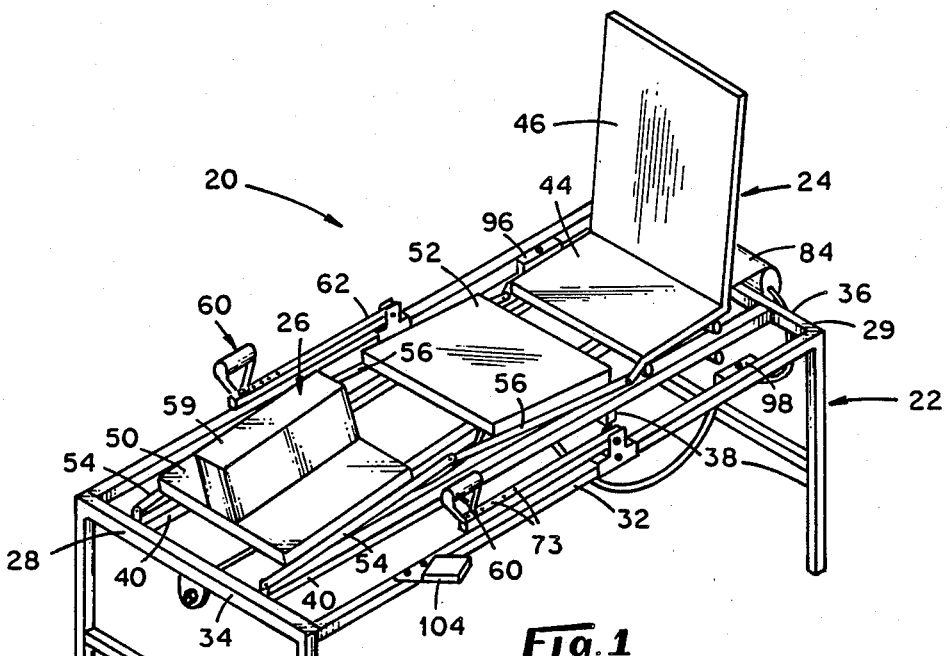
FIG. 1 is a perspective view of one embodiment of an exercise apparatus.
Figure 7:
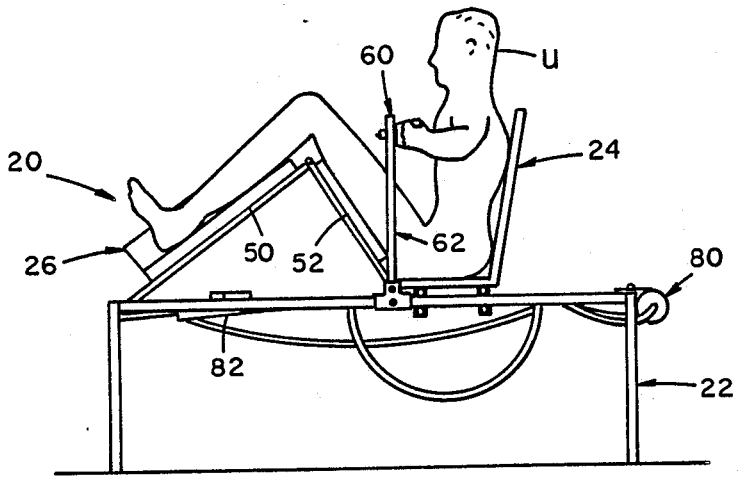
FIG. 7 is a view similar to that of FIG. 7 wherein the seat of the apparatus is positioned adjacent its forward limit of travel.

Turning now to the drawings in greater detail and considering first FIG. 1, there is shown an embodiment of an exercise apparatus, generally indicated 20, enabling a user to actively exercise his upper body while passively exercising his lower body. The apparatus 20 includes a frame 22 and a seat 24 supported upon the frame 22 for back and forth movement relative to the frame between forward and rearward limits of travel. Connected between the frame 22 and the seat 24 are hinged leg supports 26 which fold and unfold in response to the back and forth movement of the seat 24. During use of the apparatus 20 and as best illustrated in FIGS. 7 and 8, a user sits upon the seat 24 with his legs draped over the leg supports 26 and pushes and pulls upon the frame 22 to move the seat 24 back and forth relative to the frame and to effect a bending of his lower body at the waist and knees in response to the back and forth movement of the seat 24.

Figure 2:
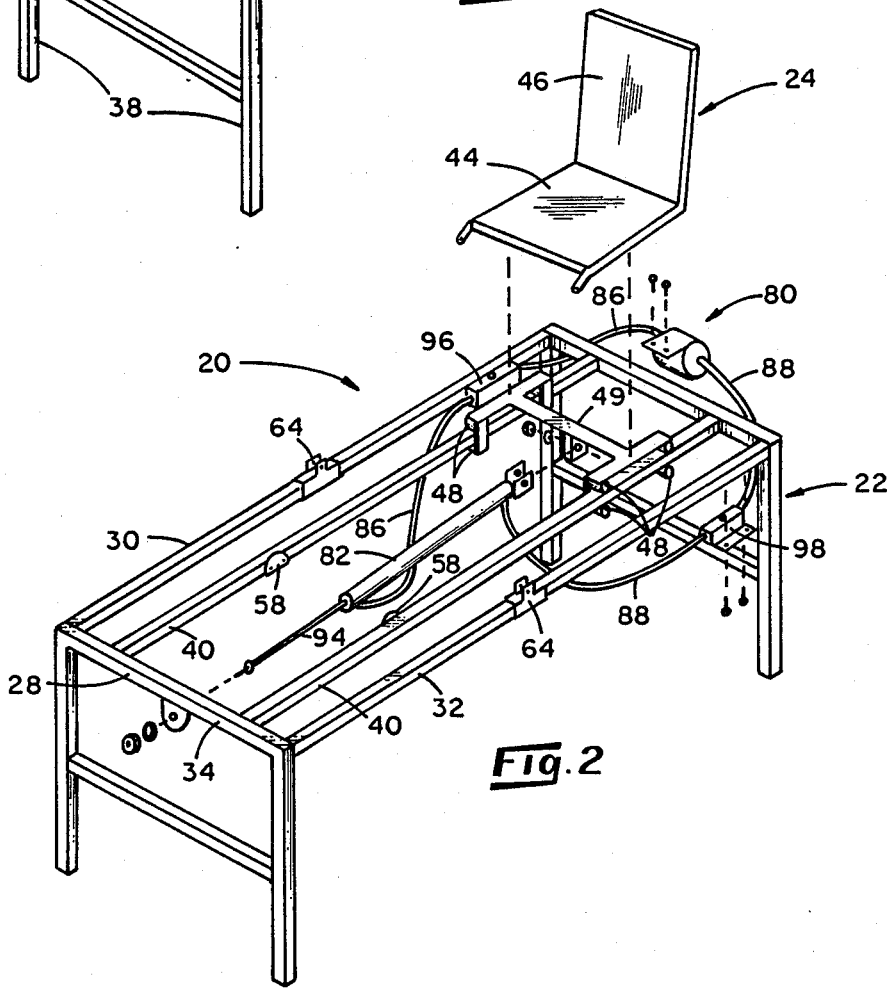
FIG. 2 is a perspective view, shown exploded, of various components of the FIG. 1 apparatus.

With reference to FIGS. 1 and 2, the frame 22 is generally elongated in form with opposite forward and rearward ends 28 and 29, respectively. The frame 22 includes a plurality of tubular members comprised, for example, of square steel tubing joined together and appropriately braced to provide an elevated support for the movable seat 24. The tubular members include two parallel side rails 30, 32 and two parallel end members 34, 36, joined together in a substantially planar arrangement and so as to provide the frame 22 with its elongate form. Two legs 38, 38 are associated with each end 28 or 29 for maintaining the planar arrangement formed by the side rails 30 and 32 and end members 34, 36 in a horizontal orientation and in an elevated condition with respect to an underlying floor. The frame 22 also includes a pair of tubular members 40 joined to so as to extend between the end members 34, 36, and which are arranged in parallel relationship. As is explained herein, the tubular members 40 serve as guide rails along which the seat 24 is guided as it is moved between its forward and rearward limits of travel.

The seat 24 includes a padded bottom 44 and back 46 for supporting the buttocks and the back of the user when the apparatus 20 is used. The bottom 44 and the back 46 are fixedly joined to one another and are arranged upon the frame 22 so that the bottom 44 is oriented generally horizontally and the back 46 extends transversely of the frame 22. As best shown in FIG. 1, the seat 24 is fixedly secured to an underlying carriage 49 which, in turn, overlies the guide rails 40.

To permit movement of the seat 24 relative to the frame 22 and as best illustrated in FIG. 2, nylon rollers 48 are interposed between the seat carriage 49 and the guide rails 40. The rollers 48 are suitably journaled to the carriage 49 and cooperate with the guide rails 40 so that as the rollers 48 are moved along the rails 40, the seat 24 is guided forwardly and rearwardly relative to the frame 22.

With reference again to FIG. 1, the leg supports 26 include a pair of padded platform-like support sections 50, 52 for supporting the lower and upper portions, respectively, of the user's legs. The supports 50, 52 are hingedly connected for pivotal movement relative to one another and relative to the frame 20 and seat 24 so that as the seat 24 is moved forwardly and rearwardly, the supports 50, 52 simulate a folding and unfolding action. In this connection, the support 50 is supported upon a pair of parallel linkage members 54, and the support 52 is supported by a pair of parallel linkage members 56. The linkage members 54 are each pivotally connected at one end to the guide rails 40 adjacent the forward end 28 of the frame 22 and are each pivotally connected at the other end to one end of a corresponding linkage member 56. The other end of each linkage member 56 is pivotally connected to the front of the seat 24. By substituting linkage members which are adjustable in length for the linkage members 56, the leg supports 26 can be adjusted to accommodate users having legs of different length. Moreover, a padded divider 59 associated with the support 50 maintains a separation between the user's calves to enhance the user-comfort of the apparatus 20.

Figure 6:
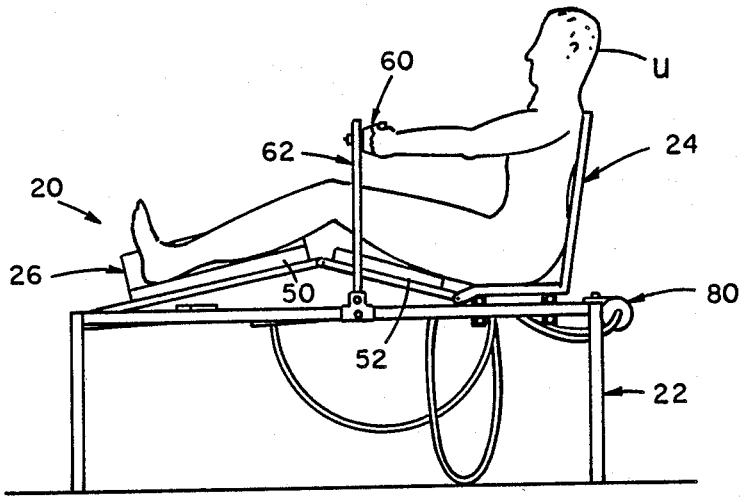
FIG. 6 is a side elevation view of the FIG. 1 apparatus shown being utilized by a user wherein the seat of the apparatus is positioned adjacent its rearward limit of travel.

It follows that as the seat 24 is moved forwardly and rearwardly along the guide rails 40, the leg supports 26 move between an extended condition as illustrated in FIG. 6 to a folded condition as illustrated in FIG. 7. Rearward movement of the seat 24 along the rails 40 is limited by the extension length of the leg supports 26, and forward movement of the seat 24 along the guide rails 40 is limited by stops 58 (FIG. 2) appropriately secured along the length of the rails 40 for engagement with the seat carriage 49 when the seat 24 is moved forwardly along the rails by a preselected amount.

Figure 3:
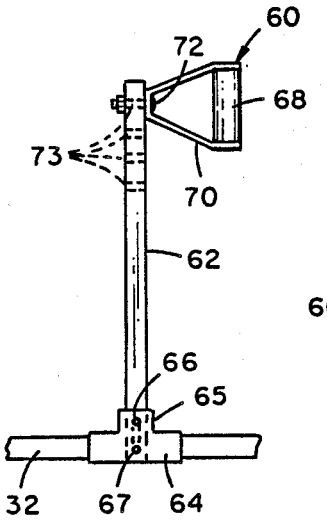
FIG. 3 is a side elevational view of a handgrip of the FIG. 1 apparatus shown positioned in a condition for use.
Figure 4:
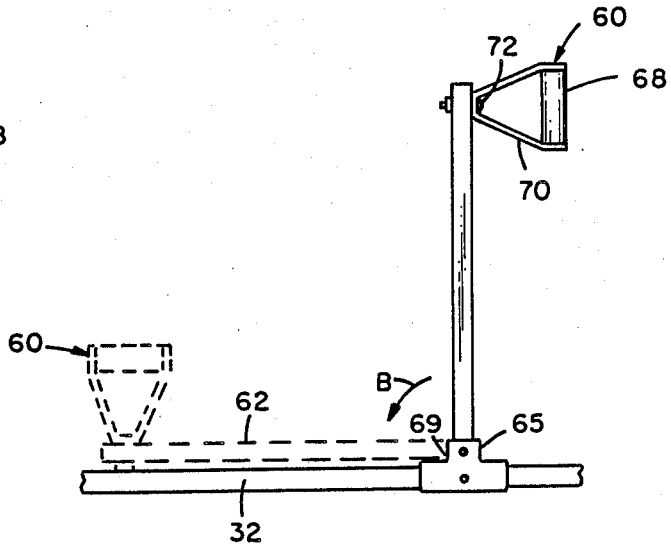
FIG. 4 is a view similar to that of FIG. 3 illustrating the handgrip when arranged in an alternative position.

With reference to FIGS. 1, 3, and 4, the apparatus 20 also includes a pair of handgrips 60, 60, and associated support posts 62, 62 facilitating the efforts by the user to push and pull upon the frame 22 during use of the apparatus. For attachment of each support post 62 to a corresponding side rail 30 or 32, there is incorporated within each rail 30 or 32 a hollow T-shaped brace member 64 positioned substantially midway along the length of the rail and arranged so that one leg 65 of the T of the member 64 extends upwardly. Each rail 30 or 32 defines an opening which is aligned with the upwardly-directed opening of the leg 65 to provide a socket for receiving one end of a support post 62 in the manner illustrated in FIG. 3. The received end of the support post 62 is slotted and pivotally connected through the slot to the brace member 64 by means of a pivot pin 66. The post slot accommodates a raising and lowering the post 62 between a lower position of use as illustrated in FIG. 3 and a raised condition as illustrated in solid lines in FIG. 4. The support post 62 is releasably secureable in its FIG. 3 condition of use by means of a headed pin 67 insertable through aligned openings in the member 64 disposed beneath the pivot pin 66 and through the slot of the post 62. With the headed pin 67 inserted through the post slot as aforedescribed, the post 62 is secured in a stationary condition with respect to the frame 22.

For enabling a user to easily move onto and off of the seat 24 between uses of the apparatus 20, the apparatus 20 may include means permitting the support post 62 to be moved from its upstanding condition as illustrated in FIG. 3 to an out-of-the-way condition. For example and as best shown in FIG. 4, each leg 65 of the brace members 64 has an open side 69 accommodating a pivoting of its corresponding support post 62 in the direction of the arrow B from the raised condition as illustrated in solid lines in FIG. 4 to a horizontal condition as illustrated in phantom in FIG. 4. To move the post 62 to the FIG. 4 phantom condition from its FIG. 3 position of use, the headed pin 67 is removed from the member 64, the post 62 is raised to its FIG. 4 solid-lined position, and the post 62 is pivoted forwardly about the pivot pin 66. With the post 62 positioned in its horizontal or FIG. 4 phantom condition, the apparatus seat 24 is rendered more easily accessible to a user.

As best shown in FIGS. 3 and 4, each handgrip 60 includes a gripping portion 68 joined across the opening of a substantially V-shaped frame 70. The frame 70 defines an opening at it apex for receiving a bolt 72 for joining the frame 70 to the support post 62. More specifically, the bolt 72 is receivable by the apex opening of the frame 70 and an aligned opening 73 defined in the support post 62 for releasably securing the handgrip 60 to the corresponding post 62. Moreover and as best shown in FIGS. 3 and 4, the V-shaped frame 70 is shaped so that when secured to the post 62 by means of the bolt 72, the handgrip 60 is cantilevered from the post 62.

The opening 73 defined in each support post 62 is one of a series of openings 73 defined along the post length for accommodating an adjustment of the position of the handgrip 60 along the post 62. More specifically, the apex opening of the handgrip frame 70 can be selectively aligned with any of the openings 74 of the post 62 and secured thereto by the bolt 72 to alter the position of the handgrip 60 along the length of the post 62 and, hence, the height of the grip 60 relative to the corresponding side rail 30 or 32 when the post 62 is positioned in its FIG. 3 position of use.

Figure 5:
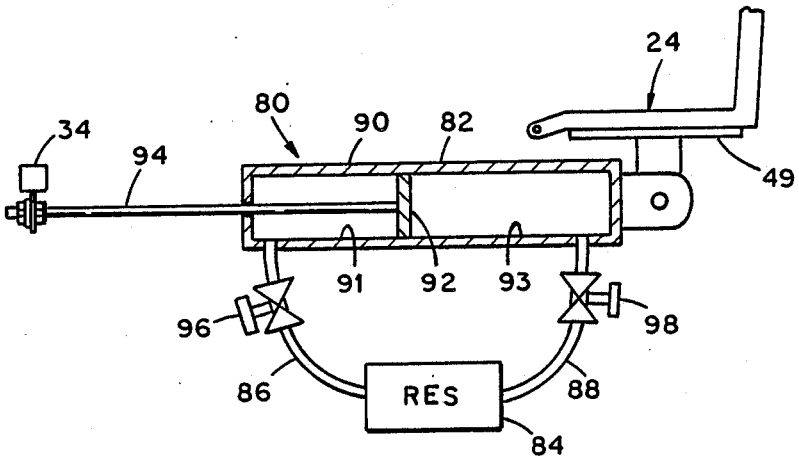
FIG. 5 is a schematic view of the hydraulic motion-resistance system of the FIG. 1 apparatus.

With reference to FIGS. 2 and 5, the apparatus 20 includes means, generally indicated 80, interposed between the seat 24 and the frame 22 for providing a resistance to movement of the seat 24 along the guide rails 40 and for providing means by which such a resistance to movement can be adjusted. In the depicted embodiment 20, the interposed means 80 includes a hydraulic system including a cylinder assembly 82, a hydraulic fluid reservoir 84 and conduits 86, 88 operatively connected between the cylinder assembly 82 and reservoir 84. As best illustrated in FIG. 5, the cylinder assembly 82 includes a cylinder 90 and a movable piston 92 positioned within so as to separate the cylinder 90 into two variable volume chambers 91, 93 filled with hydraulic fluid. One end of the cylinder 90 is joined in a stationary relationship with the seat carriage 49 and the piston 92 includes a ram 94 which is connected at one end to the frame end member 34. It follows that as the seat 24 is moved relative to and along the guide rails 40, the cylinder 90 and piston 92 are moved relative to one another in a manner increasing or decreasing the volume of each variable-volume chamber 91 or 93.

Hydraulic fluid positioned within the cylinder chambers is therefore forced out of and into reservoir 84 by way of the conduits 86, 88 as the seat 24 is moved forwardly and rearwardly relative to the frame 22.

The interposed means 80 further includes a pair of flow control valves 96, 98 incorporated within the conduits 86, 88, and supported by the frame 22 on opposite sides of the seat 24. By adjusting either or both of the valves 96, 98, the resistance to the flow of hydraulic fluid between the cylinder 90 and reservoir 84 as the seat 24 is moved along the guide rails 40 is altered so that the resistance to movement of the piston 92 and cylinder 90 relative to one another is altered. It follows that by altering the resistance to movement of the piston 92 and cylinder 90 relative to one another by adjusting the valves 96, 98, the resistance to the forward and rearward movement of the seat 22 along the rails 40 is adjusted. Hence, the interposed means 80 provides an adjustable resistance to movement of the seat in both the forward and rearward directions along the guide rails 40.

To utilize the apparatus 20 and with reference to FIGS. 6 and 7, a user 4 sits upon the seat 24 with his legs draped across the leg support 26 in the manner illustrated. If desired, the user's torso and legs can be strapped to the apparatus by means of optional straps (not shown). With the support posts 62 positioned in their upright, FIG. 3 position of use and the handgrips 60 adjusted in height to the desires of the user, the user then grasps the gripping portions of the handgrips 60 and pushes and pulls upon the frame 22 with his arms to effect forward and rearward movement of the seat 24 along the guide rails 40. For effective exercise of the upper body of the user, it is preferred that the grips 60 be pushed until the arms are fully extended as illustrated in FIG. 6, and that the grips 60 be pulled until the chest is positioned adjacent the grips 60 as illustrated in FIG. 7.

It follows that as the seat 24 is moved forwardly and rearwardly between the positions illustrated in FIGS. 6 and 7, the platform-like supports 50, 52 of the leg supports 26 fold and unfold to effect a bending of the lower body of the user at the waist and knees. Therefore, while forward and rearward movement of the seat 24 is effected entirely by the user's upper body, the joints and muscles of the lower body are passively exercised in response to the forward and rearward movement of the seat 24.

It will be understood that numerous modifications and substitutions can be had to the aforedescribed embodiment 20 without departing from the spirit of the invention. For example, an electronic counter/timer 104 can be mounted upon the frame 22 as illustrated in FIG. 1 enabling the user to evaluate progress and measure endurance. Accordingly, the aforedescribed embodiment is intended for the purpose of illustration and not as limitation.

What is claimed is:

1. Exercise apparatus for actively exercising the upper body of the user while passively exercising the lower body of the user comprising:

a frame;

a seat mounted upon the frame for generally horizontal movement relative thereto between forward and rearward positions, said seat having a bottom portion for supporting the buttocks of the user and a back portion for supporting the user's back in an upright position when the user is seated upon the bottom portion;

leg-supporting means disposed forwardly of the seat including two elongated sections for separately supporting a corresponding one of the upper and lower leg portions of at least one leg of the user, one of said two sections being connected at one of its ends to the seat for hinged movement relative thereto about a first pivot axis, the other of said two sections being connected at one of its ends to the frame for hinged movement about a second pivot axis, and said two sections being connected to one another at the ends thereof opposite said first and second pivot axes for hinged movement relative to one another about a third pivot axis so that when the user is operatively seated upon the seat with his leg operatively supported by the leg-supporting means and the seat is moved forwardly and rearwardly relative to the frame, said two sections hingedly move relative to one another, said one section hingedly moves relative to the seat and said other section hingedly moves relative to the frame in a manner effecting a folding and unfolding of the two sections and a bending of the user's leg supported by the leg-supporting means at the waist and at the knee; and handgrip means fixed in a stationary condition with respect to said frame and at about the same horizontal level as the chest of the user when the user is seated upon the seat enabling the user to push and pull upon the handgrip means with his arms to alternately extend his arms from and pull in his arms toward his chest as his hands are maintained at about chest level and to effect forward and rearward movement of the seat along the frame as the user's hands move away from and toward the user's chest and the direction of pressure applied upon the handgrip means from the hands is generally parallel to the direction of movement of the seat along the frame so that the action of the user's upper body simulates a rowing action and so that the hinged movement of said two sections of the leg-supporting means effects a bending of his supported leg at the waist and knee.

2. The apparatus as defined in claim 1 wherein said frame includes a guide rail and said seat is mounted upon the guide rail for linear movement relative to and along the rail.

3. The apparatus as defined in claim 1 wherein said one of said two sections is adapted to support the upper leg portions of both of the user's legs and the other of the two sections is adapted to support the lower portions of both the user's legs.

4. The apparatus as defined in claim 1 further comprising means interposed between the seat and frame for providing resistance to forward and rearward movement of the seat relative to the frame.

5. The apparatus as defined in claim 14 wherein said interposed means includes means for adjusting the resistance to forward and rearward movement of the seat relative to the frame.

6. The apparatus as defined in claim 5 wherein said adjusting means includes a hydraulic system having a fluid-filled cylinder operatively connected between the seat and the frame so that fluid is forced into and out of the cylinder as the seat is moved forwardly and rearwardly relative to the frame, and said adjusting means further includes means for controlling the resistance to fluid movement into and out of the cylinder to thereby control the resistance to forward and rearward movement of the seat relative to the frame.

* * * * *